US008893619B2

(12) United States Patent
Muraoka

(10) Patent No.: US 8,893,619 B2
(45) Date of Patent: Nov. 25, 2014

(54) PRINTING METHOD ON CURVED SURFACE AND CURVED SURFACE BODY PRINTED BY THAT METHOD

(75) Inventor: Kouji Muraoka, Sabae (JP)

(73) Assignee: Shuhou Co., Ltd., Fukui (JP)

( * ) Notice: Subject to any disclaimer, the term of this patent is extended or adjusted under 35 U.S.C. 154(b) by 1428 days.

(21) Appl. No.: 11/631,773

(22) PCT Filed: Aug. 26, 2005

(86) PCT No.: PCT/JP2005/015538

§ 371 (c)(1),
(2), (4) Date: Dec. 17, 2007

(87) PCT Pub. No.: WO2006/027963

PCT Pub. Date: Mar. 16, 2006

(65) Prior Publication Data

US 2008/0202370 A1 Aug. 28, 2008

(30) Foreign Application Priority Data

Sep. 10, 2004 (JP) ..... 2004-263554

(51) Int. Cl.

| | |
|---|---|
| ***B41F 3/34*** | (2006.01) |
| ***B41F 17/00*** | (2006.01) |
| ***B41M 1/02*** | (2006.01) |
| ***B41F 17/34*** | (2006.01) |
| ***B41F 5/22*** | (2006.01) |
| ***B41M 1/40*** | (2006.01) |

(52) U.S. Cl.

CPC ..... *B41F 17/001* (2013.01); *B41M 1/02* (2013.01); *B41F 17/34* (2013.01); *B41F 5/22* (2013.01); *B41M 1/40* (2013.01)

USPC ..... 101/492; 101/35; 101/40; 101/41

(58) Field of Classification Search

USPC ..... 101/492, 35, 41, 40

See application file for complete search history.

(56) References Cited

U.S. PATENT DOCUMENTS 2,124,711 A 7/1938 Rowell
3,591,276 A * 7/1971 Byrne ..... 430/124.5

(Continued)

FOREIGN PATENT DOCUMENTS

GB 748412 5/1956
GB 1 322 941 7/1973

(Continued)

OTHER PUBLICATIONS

Patent Absiract of Japan Publication No. 02-239972 Published September 21, 1990.

(Continued)

*Primary Examiner* — Judy Nguyen
*Assistant Examiner* — Quang X Nguyen
(74) *Attorney, Agent, or Firm* — Ladas & Parry LLP

(57) ABSTRACT

A method for printing on a curved surface and a printed curved surface body using the method. The method includes the steps of: applying printing ink having a viscosity of 5-500 PaS, preferably 5-250 PaS, to a protrusion portion of a relief printing master plate 3 which is a flat plate with the protrusion portion 0.1-50 μm high, preferably 0.1-25 μm high in height h; pressing a rubber or rubbery roll-like elastic blanket 2 having an elastic portion whose thickness T has a relation of 2H≤T≤8H with respect to a level difference H of a to-be-printed curved surface body 10 and which has a hardness (JIS A-scale) of 3-40, preferably 3-20, onto the relief printing master plate 3 supplied with the printing ink while applying constant pressure to the roll-like elastic blanket 2 and smoothly rotating the roll-like elastic blanket 2, so as to transfer the printing ink to an outer circumferential surface of the roll-like elastic blanket 2; and moving the roll-like elastic blanket 2 having the printing ink transferred thereto, and bringing the roll-like elastic blanket 2 into rotational pressure contact with a surface of the to-be-printed curved surface body 10 so as to perform printing thereon.

15 Claims, 7 Drawing Sheets

(56) References Cited

U.S. PATENT DOCUMENTS

| | | | | |
|---|---|---|---|---|
| 5,635,006 | A | 6/1997 | Watanabe et al. | |
| 6,568,320 | B2 * | 5/2003 | Wada et al. | 101/35 |
| 7,597,933 | B2 * | 10/2009 | Muraoka | 427/256 |
| 2003/0168639 | A1 * | 9/2003 | Cheon et al. | 252/500 |
| 2004/0142765 | A1 * | 7/2004 | Kennedy et al. | 473/351 |

FOREIGN PATENT DOCUMENTS

| | | | | |
|---|---|---|---|---|
| JP | 2-239972 | A | | 9/1990 |
| JP | 02239972 | A | * | 9/1990 |
| JP | 5-237984 | A | | 9/1993 |
| JP | 7-9665 | A | | 1/1995 |
| JP | 8-183165 | A | | 7/1996 |
| JP | 11-276639 | A | | 10/1999 |

OTHER PUBLICATIONS

Patent Abstract of Japan Publication No. 11-276639 Published October 12, 1999.

Patent Abstract of Japan Publication No. 08-183165 Published July 17, 1996.

Patent Abstract of Japan Publication No. 7-9665 A Published January 13, 1995.

Patent Absikact of Japan Publication No. 5-237984 A Published September 17, 1993.

Supplementary European Search Report in respect of corresponding EP Application No. 05780866.9, Dated May 25, 2011.

* cited by examiner (a)

(b) (SECTIONAL VIEW TAKEN ON LINE A-A')

(c) (SECTIONAL VIEW OF HIGHEST PROTRUSION PORTION)

(d) (END SURFACE VIEW OF PORTION H1)

(e) (END SURFACE VIEW OF PORTION H2)

(a)

(b)

(a)

(b)

PRINTING METHOD ON CURVED SURFACE AND CURVED SURFACE BODY PRINTED BY THAT METHOD

TECHNICAL FIELD

The present invention relates to a method for accurately printing on a to-be-printed body having a curved surface, and a curved surface body printed by the method.

BACKGROUND ART

In the background art, a printing method using an elastic blanket is known well as a method for performing various kinds of printing on a curved surface of a to-be-printed body having curved surfaces, particularly a curved surface long in a longitudinal direction thereof. That is, a background-art blanket printing method performs printing as follows. Ink is applied onto an intaglio printing master plate made of steel and plastic. Excessive ink is removed from a protrusion portion by a spatulate scraper. The surface of a soft curved elastic blanket is pressed onto the printing master plate so that the ink left in a recess portion of a conductor of the printing master plate is transferred to the elastic blanket. This elastic blanket is brought into contact with the curved surface of the to-be-printed body.

In this case, however, the printing master plate is made of steel or plastic in the background art, and the excessive ink is scraped and removed from the protrusion portion after the ink is applied. Therefore, in order to surely retain the ink in the recess portion and transfer the ink to the elastic blanket satisfactorily, the depth of the recess portion has to be made large enough. This also results in deteriorating the printing accuracy.

When the printing master plate has a large difference in height between the protrusion portion and the recess portion, the surface of the elastic blanket is deformed so largely that printing cannot be performed accurately by the elastic blanket. In addition, particularly, in the case of an intaglio plate, the depth of the recess portion has to be made large enough to retain the volume of the ink surely. When the depth is large, the elastic blanket is also deformed largely. Further, due to the recess portion, the elastic blanket itself has to be soft enough to transfer the ink in the bottom portion of the recess portion to the elastic blanket, and to be adapted to the difference between the protrusion portion and the recess portion. Thus, the conditions become worse.

With respect to that point, when the printing master plate is a relief plate, it will go well if the ink is applied to its protrusion portion. Alternatively, the protrusion portion may be made of the ink itself. The difference in height between the protrusion portion and the recess portion can be reduced. As a result, a slightly hard blanket can be used as the elastic blanket itself. In addition, since the difference between the protrusion portion and the recess portion can be reduced, the deformation of the elastic blanket surface can be reduced, and the volume of the ink can be also adjusted finely. Thus, accurate printing can be performed. As for printing on a curved surface using a relief plate and an elastic blanket, various techniques have been developed, for example, as disclosed in JP-A-2-239972.

DISCLOSURE OF THE INVENTION

Problems that the Invention is to Solve

In the background art, as described above, when printing is performed upon a to-be-printed body having a curved surface, particularly a long curved surface in the longitudinal direction, the printing is performed by the combination of a curved surface printing elastic blanket and an intaglio printing master plate. Therefore, the printing accuracy deteriorates, and multi-color printing is difficult. Particularly in the case of the intaglio plate, the volume of ink is so large that there is a disadvantage that the printing accuracy deteriorates extremely in fine dots or the like.

Further, most of conditions about the shape and properties of the elastic blanket have been set experientially by trial and error, and much time and much labor have been spent for the setting of the conditions. The setting of conditions includes setting of a shape with flexibility high enough to fit to the to-be-printed curved surface, setting of a material or a surface state desired in terms of retentivity and releasability with respect to printing ink, etc. As a result, the setting of conditions also includes setting of conditions such as desired fidelity of printing.

Particularly, when a pattern is produced on a to-be-printed curved surface body having a comparatively long shape, such as an interior member for a car, for example, a so-called fluid printing method or the like is used as the printing method. In the fluid printing method, printing ink is applied onto a water-soluble film, and the film is floated on the surface of a water solution in a transfer tank so as to transfer the ink onto a to-be-printed curved surface body 10. There is also a method in which a film or a laminate with a pattern attached thereto in advance is bonded or welded on the surface of the curved body when the curved body is molded.

In the former, however, the apparatus itself such as the transfer tank or the like becomes a large apparatus to thereby result in increase in the cost, and the pattern accuracy is also not high. On the other hand, the latter has a complicated process, and there is a possibility that the pattern cannot always deal with the curved surface.

In consideration of the aforementioned situation, an object of the invention is to provide a method for printing on a curved surface in which curved-surface printing advantageous in mass production, low in cost and high in printing accuracy is performed upon a curved-surface body having a comparatively long shape or several curved-surface bodies arranged in parallel, and to provide a curved-surface body printed by the method.

Means for Solving the Problems

A method for printing on a curved surface according to the present invention includes:

1) a method including the steps of: applying printing ink to a protrusion portion of a relief printing master plate 3 which is a flat plate with the protrusion portion 0.1-50 μm high in height h; pressing a rubber or rubbery roll-like elastic blanket 2 onto the relief printing master plate 3 disposed in a fixed position and supplied with the printing ink while applying constant pressure to the roll-like elastic blanket 2 and smoothly rotating the roll-like elastic blanket 2, so as to transfer the printing ink to an outer circumferential surface of the roll-like elastic blanket 2; and moving the roll-like elastic blanket 2 having the printing ink transferred thereto, and bringing the roll-like elastic blanket 2 into pressure contact with a curved surface of a to-be-printed curved surface body 10 so as to perform printing thereon;

2) a method including the steps of: applying printing ink to a protrusion portion of a relief printing master plate 3 which is a flat plate with the protrusion portion 0.1-50 μm high in height h; pressing a rubber or rubbery roll-like elastic blanket 2, which has a curved surface with a predetermined shape set correspondingly to a curved surface of a to-be-printed curved surface body 10 and formed in the same polarity direction as the curved surface of the to-be-printed curved surface body 10, onto the relief printing master plate 3 disposed in a fixed position and supplied with the printing ink, so as to transfer the printing ink to the curved surface with the predetermined shape; and moving the roll-like elastic blanket 2 having the curved surface with the predetermined shape having the printing ink transferred thereto, and bringing the roll-like elastic blanket 2 into contact with the curved surface of the to-be-printed curved surface body 10 so as to perform printing thereon;

3) a method according to the aforementioned method 1) or 2), wherein a radial thickness T of the roll-like elastic blanket 2 has at least a relation of $2 \leq H \leq 8H$ to a level difference H of the highest protrusion portion in the curved surface of the to-be-printed curved surface body 10;

4) a method according to anyone of the aforementioned methods 1) through 3), wherein a material of the roll-like elastic blanket 2 is silicone rubber, and hardness (JIS A-scale) thereof is 3-40, preferably 3-20;

5) a method according to any one of the aforementioned methods 1) through 4), wherein a height h of the protrusion portion of the relief printing master plate 3 is 0.1-25 μm;

6) a method according to anyone of the aforementioned methods 1) through 4), wherein a height h of the protrusion portion of the relief printing master plate 3 is 0.1-15 μm;

7) a method according to any one of aforementioned methods 1) through 6), wherein the printing ink has a viscosity of 5-500 PaS;

8) a method according to anyone of the aforementioned methods 1) through 6), wherein the printing ink has a viscosity of 5-250 PaS;

9) a method according to any one of the aforementioned methods 1) through 6), wherein the printing ink has a viscosity 1⅕ times as high as a viscosity of a usual offset ink as practical measure;

10) a method according to any one of the aforementioned methods 1) through 9), wherein surface roughness of the roll-like elastic blanket 2 is 0.5-2 μm in Hmax;

11) a method according to the aforementioned method 1) or any one of the aforementioned methods 3) through 10), wherein an image of the protrusion portion of the relief printing master plate 3 where the printing ink is applied to the protrusion portion of the relief printing master plate 3 which is a flat plate is disposed to be reduced or enlarged based on a ratio between an orthogonal projection of the curved surface onto the relief printing master plate 3 and a real length of the curved surface; and 12) a method according to any one of the aforementioned methods 1) through 11), wherein the to-be-printed curved surface body 10 is a to-be-printed curved surface body having a shape long in a longitudinal axis direction or a to-be-printed body where a plurality of to-be-printed curved surface bodies 10 are arranged in parallel in the longitudinal axis direction.

Further, the method for printing on a curved surface according to the present invention includes:

13) a method according to any one of the aforementioned methods 2) through 11), wherein: the curved surface of the to-be-printed curved surface body 10 is a curved surface particularly having a shape long in a longitudinal axis direction and has protrusion portion curvature radii R at least along the longitudinal axis direction, which radii R are uniform over corresponding width-direction positions respectively; a principal axis section of the predetermined shape curved surface of the roll-like elastic blanket 2 corresponding to each of the protrusion portion curvature radii R includes two principal curved surfaces and a top portion curved surface smoothly connecting a crossing portion between the two principal curved surfaces; each of the two principal curved surfaces has curvature radii r composing a curved surface with a predetermined shape correspondingly to the curvature radii R of the principal axis section of the protrusion portion curved surface of the to-be-printed curved surface body 10; each of the curvature radii r is one to three times as large as corresponding one of the curvature radii R, and a value with which distances L (=2×) between two centers of the two principal curved surfaces r0 cross each other is 0.05-0.15 times as large as the curvature radius R; and the end portion curved surface has curvature radius equivalent to the curvature radius of the to-be-printed curved surface body 10; and 14) a method having a combination of the steps using a method for printing on a curved surface according to any one of the aforementioned methods 1) through 13), and other steps using a method for printing on a curved surface which method follows the aforementioned methods 1) through 13) but uses a pad type blanket in place of the roll-like elastic blanket 2.

A printed curved surface body according to the present invention includes:

15) a printed curved surface body having a surface printed by a method for printing on a curved surface according to any one of the aforementioned methods 1) through 14);

16) a printed curved surface body according to the aforementioned body 15), wherein the printed curved surface body is an automobile part;

17) a printed curved surface body according to the aforementioned body 15), wherein the printed curved surface body is a handle or an interior or exterior member for a car;

18) a printed curved surface body according to the aforementioned body 15), wherein the printed curved surface body is an exterior member of electronic equipment;

19) a printed curved surface body according to the aforementioned body 15), wherein the printed curved surface body is an exterior member of a portable telephone;

20) a printed curved surface body according to the aforementioned body 15), wherein the printed curved surface body is an ornament or a sporting tool; and 21) a printed curved surface body according to the aforementioned body 15), wherein the printed curved surface body is an eyeglass frame.

Effect of the Invention

According to a method for printing on a curved surface according to the present invention, accurate printing on a curved surface of a to-be-printed curved surface body 10 or particularly a to-be-printed curved surface body 10 having a shape comparatively long in its longitudinal axis direction, and a printed curved surface body using the method can be provided comparatively and inexpensively.

BEST MODE FOR CARRYING OUT THE INVENTION

Figure 1:
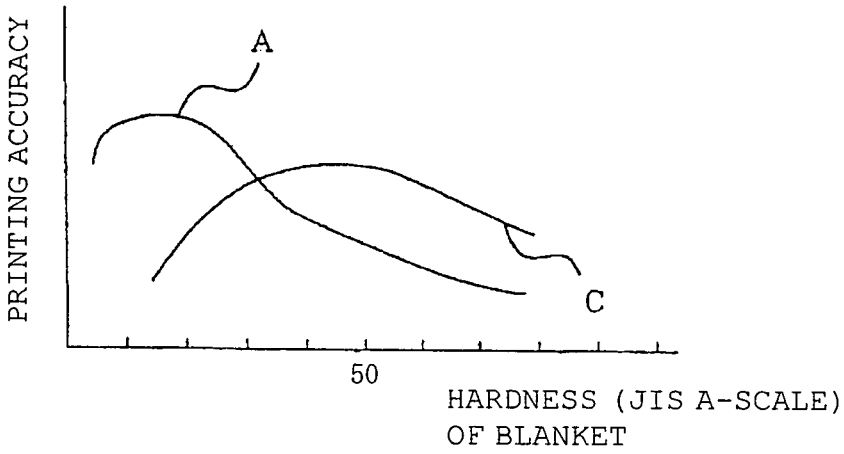
FIG. 1 is a graph showing the relation between hardness (JIS A-scale) of a roll-like elastic blanket 2 (silicone rubber) used in the present invention and the printing accuracy.

The present invention is characterized in that the manufacturing specifications of a roll-like elastic blanket 2 which have heretofore depended on feeling and experience can be simplified and determined easily. The present invention is also characterized in that a combination of an appropriate roll-like elastic blanket 2 based on determined specifications and a special relief master plate 3 having an extremely small level difference in a protrusion portion is further combined with a characteristic low-viscosity (thin) printing ink so that printing on a curved surface with high printing accuracy can be obtained efficiently and inexpensively. The present invention is further characterized by providing a printed curved surface body 10, particularly a handle, an interior or exterior member or the like for a car, which can be obtained efficiently and inexpensively by the curved surface printing method.

That is, preferred specifications of the roll-like elastic blanket 2 and the relief printing master plate 3 are specified in the following aspects.

(1) An elastic blanket shape and an elastic blanket material (particularly hardness and elastic modulus) corresponding to the shape of a to-be-printed curved surface body 10, particularly the shape of a curved surface of a curved surface body having a shape long in the longitudinal axis direction thereof.

(2) Elastic blanket surface properties (ink spreadability and releasability) with which printing ink on the relief printing master plate 3 is transferred to the elastic blanket surface efficiently so that the ink can be printed on the to-be-printed curved surface body 10 efficiently.

(3) Setting of height of the protrusion portion of the relief printing master plate 3 and accuracy Silicone rubber is chiefly used as the material of the roll-like elastic blanket 2. The roll-like elastic blanket 2 is required to have surface properties including ink absorbability with which ink can be transferred from the relief printing master plate 3 to the elastic blanket surface, a property with which a solvent component of the ink can be absorbed to increase the ink viscosity, releasability with which the ink can be transferred perfectly to the surface of the to-be-printed curved surface body 10, and a property with which the ink can be prevented from surviving in the elastic blanket surface after being printed on the to-be-printed curved surface body 10.

These properties are closely related to the performance of printing ink to be used. In view from the roll-like elastic blanket 2, the properties depend on the surface free energy of the elastic blanket surface itself. The properties highly depend on the material of the elastic blanket and the form of the elastic blanket surface, particularly the surface roughness thereof.

That is, the absorbability with which ink can be transferred from the relief printing master plate 3 to the elastic blanket surface, the releasability with which the ink can be transferred perfectly to the to-be-printed curved surface body 10, and the property with which the ink can be prevented from surviving in the elastic blanket surface after being printed on the to-be-printed curved surface are antithetical properties. It is difficult to allow the elastic blanket material itself to change these properties in a short time during a printing process. In addition, when the to-be-printed curved surface body 10 has a large difference in level, the surface displacement of the elastic blanket becomes large inevitably. Thus, the antithetical properties become more complicated.

The present applicant conducted many experiments and obtained knowledge as follows. In a real operation process of the roll-like elastic blanket 2 according to the present invention, that is, in a combination of a step (A) of transferring ink from the relief printing master plate 3 to the curved elastic blanket 2 (wherein the elastic blanket surface displaces from a curved surface to a flat surface), a step (B) of moving the elastic blanket to the position of the to-be-printed curved surface body 10 (wherein the elastic blanket surface displaces from the flat surface to the curved surface) and a step (C) of pressing the elastic blanket onto the to-be-printed curved surface body 10 so as to perform printing on the curved surface (the elastic blanket surface displaces from a positive-polarity curved surface to a negative-polarity curved surface), the ink retentivity of the curved elastic blanket surface can change and follow the aforementioned antithetical properties comparatively in a range of roughness.

As a result of comparison tests which will be described later, the elastic blanket will cause a problem if its surface roughness is too fine or too rough. When the elastic blanket is fine in surface roughness, the elastic blanket has comparatively high retentivity but a defect in releasability. When the elastic blanket is too rough, the retentivity deteriorates but the releasability is comparatively high. Particularly in a range of 0.5-2 μm, both the retentivity and the releasability are satisfactory. It is preferable that the surface roughness of the printing curved elastic blanket according to the present invention is set in the range of 0.5-2 μm.

Silicone rubber is preferred as the material of the roll-like elastic blanket 2. The silicone rubber is comparatively well-balanced among the aforementioned properties, that is, the absorbability with which ink can be transferred from the relief printing master plate 3 to the elastic blanket surface, the releasability with which the ink can be transferred perfectly to the to-be-printed curved surface, and the property with which the ink can be prevented from surviving in the elastic blanket surface after being printed on the to-be-printed curved surface. The silicone rubber generally put into practical use has a hardness of 20-90. As proved from many test results, the roll-like elastic blanket 2 is desired to have a material hardness (JIS A-scale) of about 3-40, preferably to be comparatively soft and have a material hardness of about 3-20 in view of a displacement.

FIG. 1 is a graph showing the relationship between the hardness (JIS A-scale) of the roll-like elastic blanket 2 (silicone rubber) and the printing accuracy.

In FIG. 1, the curve A designates a test result with the roll-like elastic blanket 2 (silicone rubber) according to the present invention, and the curve C designates a test result in background-art relief printing. From FIG. 1, it is understood that it is desired that the roll-like elastic blanket 2 has a material hardness (JIS A-scale) of about 3-20.

As described above, the surface shape of the roll-like elastic blanket 2 changes in each of the step (A) of transferring ink from the relief master plate to the curved elastic blanket (wherein the elastic blanket surface displaces from a curved surface to a flat surface), the step (B) of moving the elastic blanket to the position of the to-be-printed curved surface body 10 (wherein the elastic blanket surface displaces from the flat surface to the curved surface) and the step (C) of pressing the elastic blanket onto the to-be-printed curved surface body 10 so as to perform printing on the curved surface (the elastic blanket surface displaces from the curved surface of the roll-like elastic blanket 2 to the curved surface of the to-be-printed curved surface body 10). Therefore, the accuracy to transfer an image in the step A which is an initial step is extremely important. The present invention is characterized in that the height of a protrusion portion applied with ink in the relief master plate is made as low as possible, so that the accuracy to transfer an image and hence the printing accuracy can be improved.

That is, the present invention is characterized by a combination of a roll-like elastic blanket 2 having an appropriate hardness, a relief master plate with a protrusion portion extremely low in height, and printing ink having an appropriate viscosity. Consequently, the printing accuracy can be preserved, and the curved surface printing can be also applied to multi-color printing.

In this case, the flat relief master plate is made of an aluminum alloy plate, and the protrusion portion is formed out of a photosensitive agent.

The protrusion portion has a height of 0.1-50 μm, preferably 0.1-25 μm, more preferably 0.1-15 μm. It is important that the protrusion portion has height necessary and sufficient to transfer ink to the roll-like elastic blanket 2.

An intaglio master plate is usually used as a master plate in printing with an elastic blanket. Based on common sense, the intaglio printing master plate has a recess portion formed by an exposure and corrosion method. The depth of the recess portion is at least about several tens of times as large as the coating thickness of the photosensitive agent. Ink is scraped from a protrusion portion of the intaglio master plate, and ink reserved in the recess portion is transferred to the elastic blanket. Therefore, in curved surface printing where the depth of the recess portion is so large as to change the surface shape, the accuracy to transfer the ink deteriorates, and hence the printing accuracy deteriorates.

On the other hand, according to the method of the invention where ink applied to the protrusion portion of the relief printing master plate 3 extremely low in height is transferred, the relief printing master plate 3 to be used has a protrusion portion whose height h is 0.1-50 μm, preferable 0.1-25 μm, more preferably 0.1-15 μm. Thus, high printing accuracy can be obtained even with the roll-like elastic blanket 2.

Figure 2:
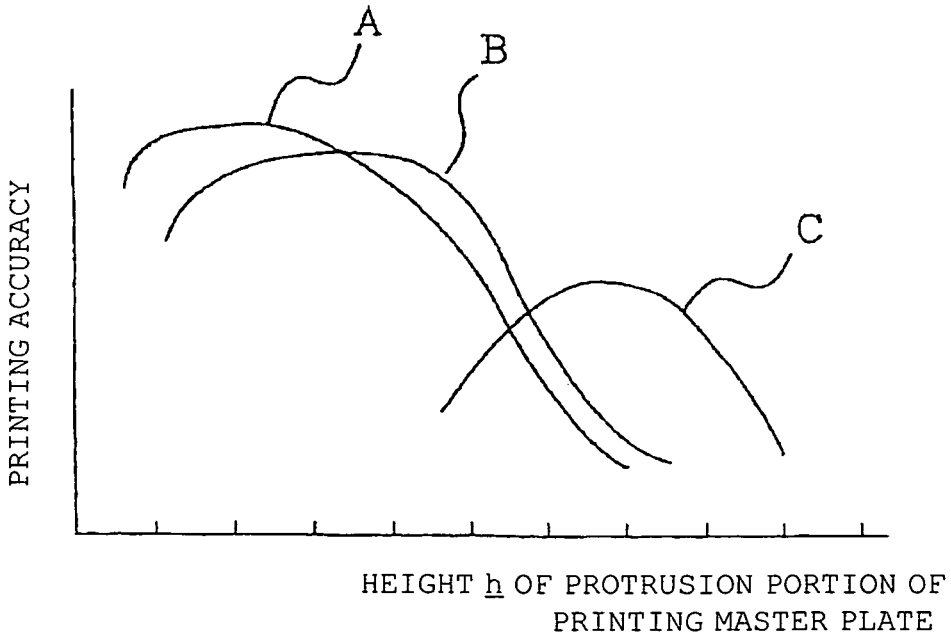
FIG. 2 is a graph showing test results as to the relation between height of a protrusion portion of a printing master plate 3 (depth of a recess portion in the curve C) according to the present invention and the printing accuracy.

FIG. 2 is a graph showing test results as to the relation between the height h of the protrusion portion of the relief printing master plate 3 (depth of a recess portion in the curve C) and the printing accuracy.

In FIG. 2, the following facts were proved. There is a peak of printing accuracy in a range of the height h of the protrusion portion or the depth of the recess portion. In the case (A) according to the present invention, the peak of printing accuracy thereof is higher than the peak in a background-art intaglio printing master plate (C) when the height h of the protrusion portion is 0.1-50 μm. In addition, the accuracy in the case (A) according to the present invention is higher than the accuracy in background-art relief printing (B) when the height h of the protrusion portion is 3-25 μm, preferably 0.1-15 μm.

It is not preferable that the protrusion portion is not higher than 0.1 μm because the degree of freedom in a printing process is extremely narrowed.

Not to say, the printing ink to be used is selected to have the ink absorbability, the property with which a solvent component of the ink can be absorbed to increase the ink viscosity, and the releasability with which the ink can be transferred perfectly, in the roll-like elastic blanket 2, and to satisfy the property with which the ink can be prevented from surviving in the surface of the elastic blanket 2 after printed on the to-be-printed curved surface body 10. In the present invention, it is further important to select the printing ink so as to deal with the extremely low height of the protrusion portion of the relief printing master plate 3. In practical use, the printing ink is selected in balance among these properties.

The present applicant obtained the following knowledge due to many basic tests and real experiments.

As a result of many practical tests, it was proved that preferably the viscosity of printing ink is in a range of 5-500 PaS (at 25° C.). In addition, the viscosity of printing ink has to be 5-250 PaS (at 25° C.) when the height h of the protrusion portion of the relief printing master plate 3 is 0.1-15 μm.

In the present invention, it is not preferable that the viscosity is lower than 5 PaS because stain other than an image appears in the relief printing master plate 3.

When the viscosity is higher than 250 PaS, it is difficult for the ink to spread on the surface of the curved surface printing elastic blanket 2 of silicone rubber. That is, the absorbability onto the surface of the elastic blanket 2 deteriorates. Further, when the height of the protrusion portion is not higher than 15 μm, satisfactory printing accuracy cannot be kept in the viscosity not lower than 500 PaS (at 25° C.).

As for a practical measure of the viscosity of the printing ink in the present invention, the viscosity may be made about 1⅕ times as high as the viscosity of offset printing ink used in the same conditions in usual flat-plate offset printing. In this case, the aforementioned conditions can be satisfied substantially.

In order to obtain printing on a curved surface with high accuracy, the surface of the elastic blanket 2 has to fit the curved surface of the to-be-printed curved surface body 10 satisfactorily. To this end, an elastic portion of the roll-like elastic blanket 2, that is, the radial thickness of silicone rubber in the case has to have a thickness T required to sufficiently follow the irregularities of the curved surface. Silicone rubber has an extremely high Poisson's ratio. Therefore, the lateral displacement with respect to the pressurization direction is large. The silicone rubber has to have a radial thickness T large enough to absorb this lateral displacement sufficiently. As a result of real tests, it was proved that when silicone rubber having a material hardness (JIS A-scale) of about 3-40, particularly preferably silicone rubber comparatively soft to have a material hardness of about 3-20 is used, the radial thickness T of the roll-like elastic (silicone rubber) blanket 2 should be at least twice as large as a maximum difference H in level among irregularities in the to-be-printed curved surface body 10. If the thickness T does not satisfy this condition, the elastic blanket 2 cannot fit the curved surface sufficiently.

When the thickness T is 8 times or more as large as the difference H, the contact state between the protrusion top surface of the to-be-printed curved surface body 10 and the outer circumferential surface of the roll-like elastic blanket 2 gets close to a contact state between flat surfaces. It was therefore proved that printing missing caused by very small air voids appears in the printed surface of the protrusion top surface portion, due to the contact state.

It is therefore desired that the radial thickness T of the roll-like elastic (silicone rubber) blanket 2 according to the present invention has at least a relation $2H \leq T \leq 8H$ with respect to the maximum difference H in level among the irregularities in the to-be-printed curved surface body 10.

The curved surface of the to-be-printed curved surface body 10 may have a shape with a comparatively small difference in level among the irregularities or a shape with irregularities smoothly displaced at a comparatively long pitch. Or a print image to be printed may be an image that does not need comparatively high accuracy. In such a case, an elastic blanket whose outer circumference with a straight cylindrical shape is used as it is can be selected as the roll-like elastic blanket 2. When the to-be-printed curved surface body 10 has a gentle variation in its longitudinal axis direction, the roll-like elastic blanket 2 can be designed to have a tapered shape or a shape similar thereto within the aforementioned limited range of the thickness T.

The roll-like elastic blanket 2 having the straight cylindrical shape or the tapered shape may be requested to perform printing on a curved surface with higher accuracy. In this case, due to the outer circumferential surface of the roll-like elastic blanket 2, printing by the flat relief printing master plate 3 is expanded or contracted on the curved surface of the to-be-printed curved surface body 10. Thus, the printing accuracy deteriorates correspondingly. In such a case, therefore, it is preferable that an image in the flat relief printing master plate 3 corresponding to each portion to be expanded or contracted in a final image on the to-be-printed curved surface body 10 is provided as an image contracted or expanded in advance.

Fundamentally the image is provided to be contracted or expanded with reference to the ratio between the orthogonal projection of the curved surface of the to-be-printed curved surface body 10 onto the relief printing master plate 3 and the real length of the curved surface.

The outer circumferential shape of the roll-like elastic blanket 2 may be specified to have a curved surface corresponding to the curved surface of the to-be-printed curved surface body 10 as follows.

That is, a comparatively simple specification setting system has been obtained for the pressure contact between the outer circumferential shape of the roll-like elastic blanket 2 and the curved surface of the to-be-printed curved surface body 10. The system is fundamentally based on Hertz Stress theory where a cylindrical outer circumferential surface and a curved surface are brought into pressure contact, and is modified based on many experiments.

The present invention is aimed at a gentle curved surface having a comparatively large curvature radius. The to-be-printed curved surface body 10 having a curved surface portion with a small curvature radius can be processed as follows. That is, the curved surface printing using the roll-like elastic blanket 2 which is a main printing method according to the present invention can be combined with another pad-like curved surface printing method as will be described later. The latter method is applied to the curved surface portion with a small curvature radius.

The shape of the elastic blanket 2 has chiefly three components with respect to a sectional curvature radius R in a section perpendicular to the longitudinal axis direction of the to-be-printed curved surface body 10.

Figure 3:
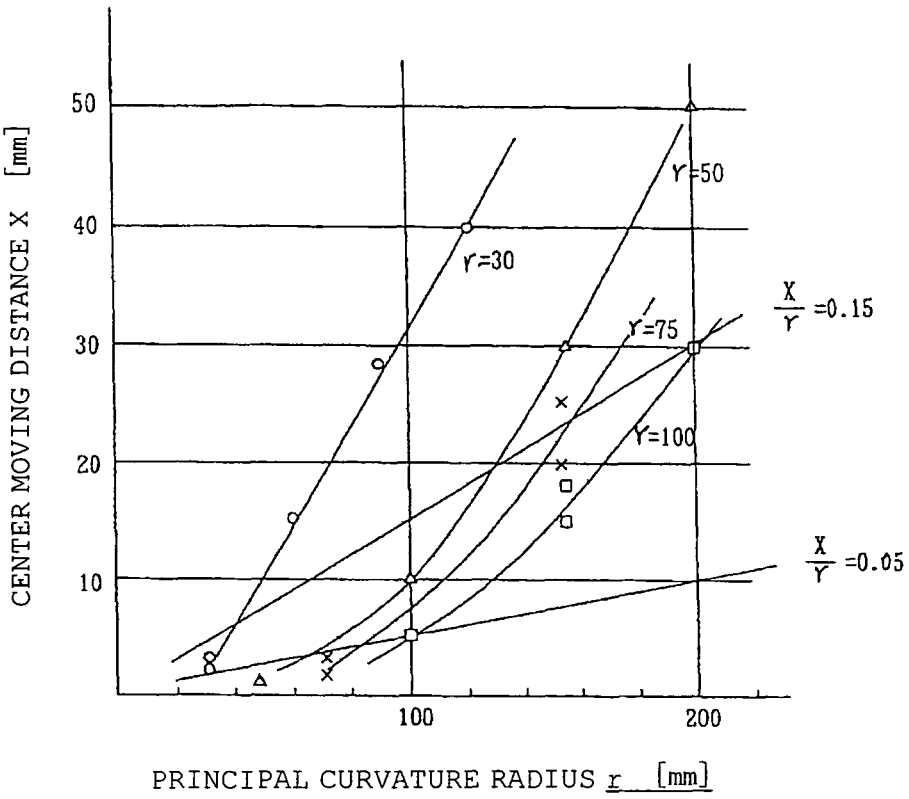
FIG. 3 is a graph showing the relation between a principal curvature radius r of the elastic blanket in the present invention, and a moving distance X of the center thereof.

That is, two are curved surface portions of the elastic blanket each having a principal curvature radius r obtained from FIG. 3 correspondingly to the sectional curvature radius R, and the other is a portion rounded by an arc rt (vertex angle about 25°) inscribed in a top portion where the two curved surface portions meet each other.

The shape of the elastic blanket 2 in its longitudinal axis direction is based on a generatrix R1 in the longitudinal axis direction connecting the outermost protrusion portions of sections perpendicular to the longitudinal axis direction of the to-be-printed curved surface body 10. That is, the outer circumferential shape in the longitudinal axis direction is set by principal curvature radii r01, r02, r03, . . . of sections at points 01, 02, 03, . . . on a curvature radius r1 of the elastic blanket 2 corresponding to the generatrix R1.

Also in this case, it is necessary that the radial thickness T of the roll-like elastic (silicone rubber) blanket 2 has at least a relation $2H \leq T \leq 8H$ with respect to the maximum difference H in level among the irregularities in the to-be-printed curved surface body 10 as described previously.

The principal curvature radii r01, r02, r03, . . . each composing the two curved surfaces in the aforementioned respective points move by a distance X inward in the directions crossing their centers. The length of the arc defined by each principal curvature radius should be set properly to print, at most, half of the circumference of the to-be-printed curved surface body 10 having a sectional curvature radius R.

From many experimental results, it is desired that the principal curvature radius r0 in the roll-like elastic blanket 2 is made 1-3 times, preferably 1-2 times as large as the sectional curvature radius R of the to-be-printed curved surface body.

Figure 8:
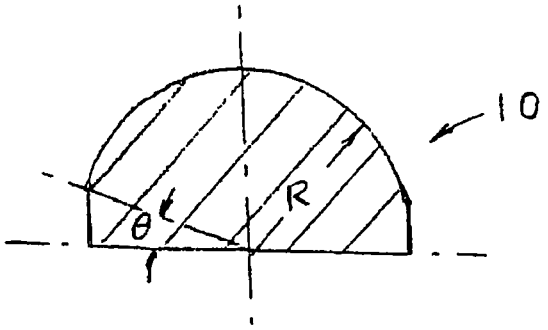
FIG. 8 are schematic views showing the relation between a principal curvature radius r of the roll-like elastic blanket 2 corresponding to a principal curvature radius R of the to-be-printed curved surface body 10, and the moving distance X of the center thereof.
Figure 8:
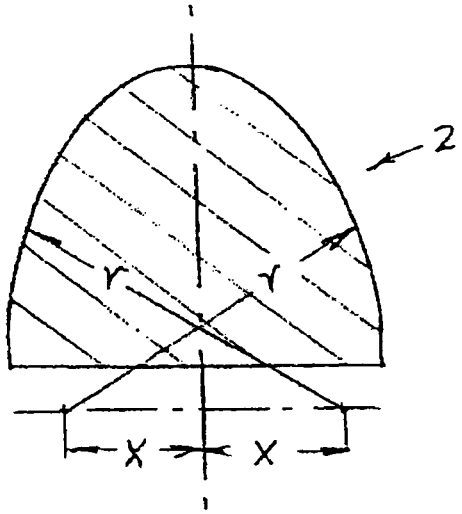

FIG. 3 is a graph showing the relationship between the principal curvature radius r of each section composing the two curved surfaces meeting each other in the elastic blanket 2, and the preferable distance X moving inward in the directions crossing their centers. FIG. 8 are schematic views showing the relationship between the principal curvature radius r of the roll-like elastic blanket 2 corresponding to the sectional curvature radius R of the to-be-printed curved surface body 10, and the moving distance X of the center thereof.

From FIG. 3, the moving distance X of the center is selected.

When the principal curvature radius r0 is set to be large as compared with the sectional curvature radius R of the to-be-printed curved surface body 10, the moving distance X of the center must be increased substantially in proportion to the principal curvature radius r0. When the sectional curvature radius R of the to-be-printed curved surface body 10 is small, the moving distance X of the center has to take a comparatively large value.

It is preferable that the values X and r0 are selected so that the value of the ratio $k=X/r0$ is put in a range of 0.05-0.15.

When the radial protrusion portion level difference H in the longitudinal axis direction is comparatively large, it is preferable that a distance corresponding to a tangential bulge $\Delta X$ of the roll-like elastic blanket 2 generated with respect to the pushing direction due to a distance obtained by multiplying a difference $\Delta H$ in pushing distance corresponding to the protrusion portion level difference H in the longitudinal axis direction by a Poisson's ratio is subtracted from the aforementioned distance X.

When the printed curved surface body 10 is pushed into the elastic blanket 2 to the utmost, strain deformation due to this pushing depth (protrusion portion level difference H) also occurs in a non-contact portion of the outer circumferential surface of the elastic blanket 2 adjacent to the pushed portion. It is therefore important that the relative position where the to-be-printed surface of the to-be-printed curved surface body 10 and the roll-like elastic blanket 2 begin to get in contact with each other is determined in sufficient consideration of a distance corresponding to this strain deformation.

Assume that the to-be-printed curved surface body 10 is composed of different curvature radii R1, R2, . . . in its longitudinal axis direction. In this case, the principal curvature radii r01, r02, . . . of the curved surface corresponding to the longitudinal-axis-direction principal curvature radii r1, r2, . . . in the outer circumferential shape along the longitudinal axis direction of the roll-like elastic blanket 2 are set in consideration in the same manner as the aforementioned manner with which the principal curvature radius r is set with respect to the curvature radius R.

EXAMPLE 1

Figure 4:
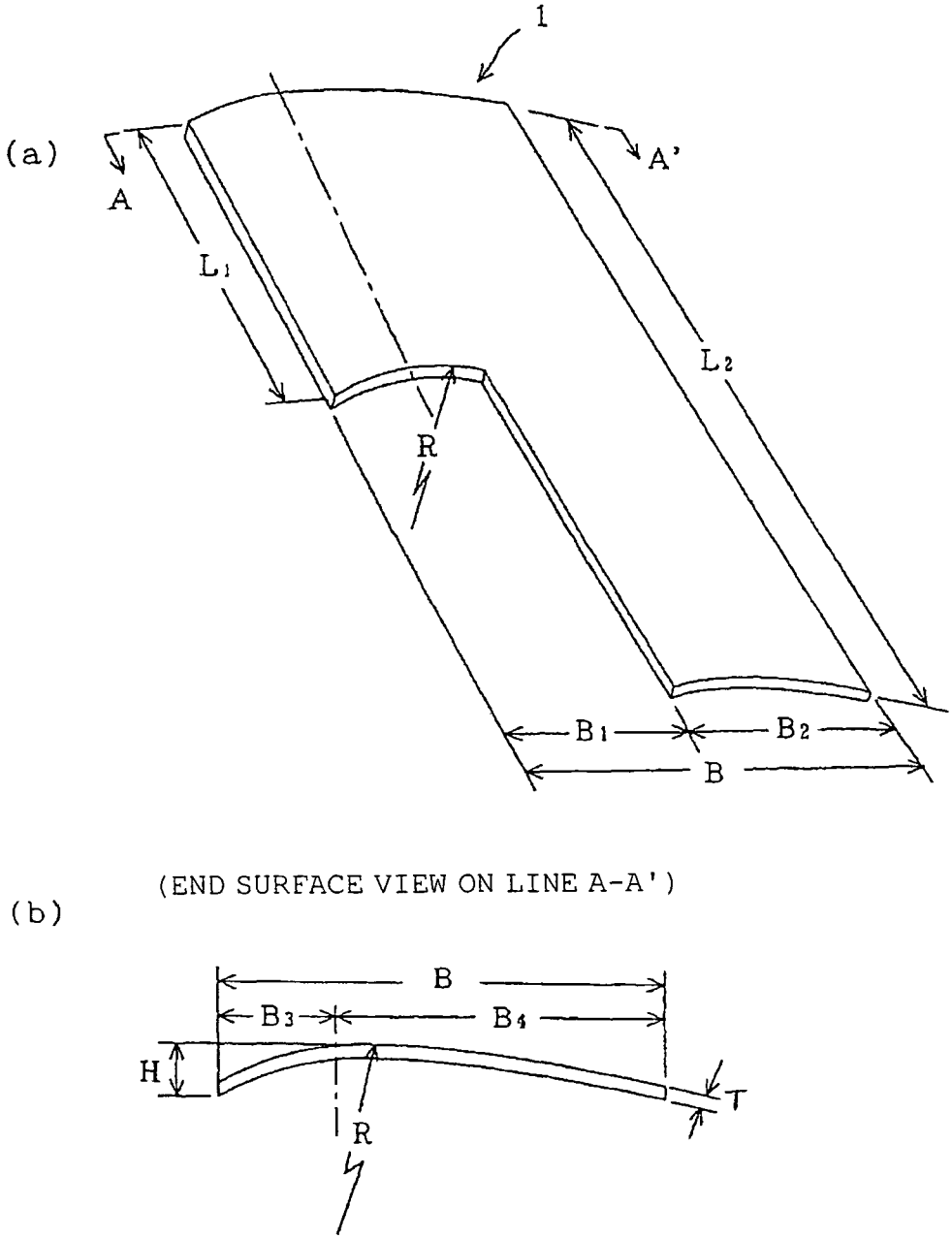
FIG. 4 are schematic views showing a schematic shape of a to-be-printed curved surface body sample 1 in Example 1 of the present invention.

FIG. 4 are schematic views showing the schematic shape of a to-be-printed curved surface body sample 1 in Example 1 of the present invention.

In FIG. 4, the reference numeral 1 represents a to-be-printed curved surface body sample; B, a sample breadth; $B_1$, a sample breadth (1); $B_2$, a sample breadth (2); $B_3$, a sample breadth (3) to a highest protrusion portion of the to-be-printed curved surface body sample; $B_4$, a sample breadth (4) to the highest protrusion portion; H, a level difference of the highest protrusion portion; $R_1$, a curvature radius of the highest protrusion portion; and t, thickness of the sample.

Figure 5:
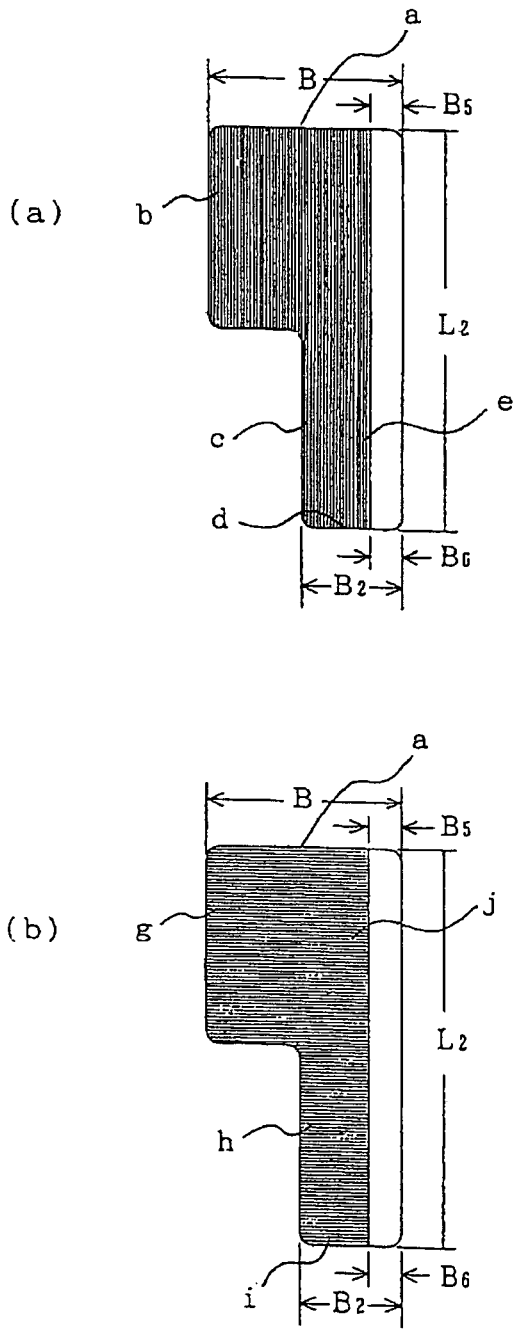
FIG. 5 show printing patterns applied to the relief printing master plate 3 in Example 1 of the present invention, wherein (a) shows a pattern parallel to the axial direction, and (b) shows a pattern perpendicular to the axial direction.

FIG. 5 show printing patterns applied to the relief printing master plate 3 in Example 1 of the present invention, wherein (a) shows a pattern parallel to the axial direction, and (b) shows a pattern perpendicular to the axial direction.

to-be-printed curved surface body sample 1:

shape; see FIG. 1, material; polypropylene (black)

$L_2$; 200 mm, B; 100 mm, $R_1$; 60 mm, H; 15 mm ($L_1$; 100, $B_1$; 50, $B_2$; 50, $B_3$; 30, $B_4$; 60, $B_5$; 10, t; 2 (*by mm*))

roll-like elastic blanket 2:

straight cylindrical roll D×d(axial diameter)×$L_0$=120 mm×40 mm×220 mm material; silicon rubber, hardness (JIS A-scale); 15 surface roughness; 1.5 s ink used:

UV-type ink (color; silver, viscosity; about 20 PaS)

relief printing master plate 3:

relief master plate made of Al photosensitive agent protrusion portion height; 5 μm continuous pattern of 0.1 mm parallel lines (regular intervals of a pitch 0.15)

(a) pattern parallel to axial direction (b) pattern perpendicular to axial direction printing machine:

horizontal displacement type three-stage roll blanket printing machine (Model 3 made by SHUHO)

The longitudinal direction L of the to-be-printed curved surface sample 1 was aligned with the axial direction of the roll-like elastic blanket 2. Two kinds of continuous patterns of 0.1 mm parallel lines, that is, (a) a pattern parallel to the axial direction and (b) a pattern perpendicular to the axial direction were made up on relief master plates made of Al. Printing tests were performed through a step (A) where the roll-like elastic blanket 2 was brought into smoothly rolling contact with each master plate, a step (B) where the elastic blanket 2 was moved to the position of the to-be-printed curved surface body 10, and a step (C) where the elastic blanket 2 was brought into smoothly pressing contact onto the to-be-printed curved surface body 10 so as to perform printing on a curved surface.

When the pattern was a pattern (a) parallel to the axial direction, the interval of the pitch was about several percentages wider in printing-start-side end portions b and c. The pitch error was reduced in a position closer to the protrusion portion, and good printing accuracy was kept in the protrusion portion. On the other hand, printing accuracy in a printing end portion e on the printing end side was as good as that in the protrusion portion due to the presence of a non-print breadth B5 (5 mm in this case).

In longitudinal end portions a and d of the to-be-printed curved surface body sample 1, deterioration in printing accuracy could be hardly recognized in the print with the line state in this Example 1.

When the pattern was a pattern (b) perpendicular to the axial direction, a printing error was obviously recognized in a longitudinal edge portion of the to-be-printed curved surface body sample. However, the error occurred in a range of 5 mm from the end portion. When the difference in level of the highest protrusion portion was about 15 mm, the error could be dealt with by avoiding printing in the range of 5 mm from the end portion or by correcting the pitch of the plate in this portion in advance. Any printing error was hardly recognized on the printing start side and the printing end side. It is therefore desired that a pattern of simple lines is printed as a pattern having the length of the lines in a direction perpendicular to the longitudinal axial direction, that is, the length of the lines in a direction perpendicular to the axial direction of the roll-like elastic blanket 2.

The axial center of the curvature radius of the protrusion portion of the to-be-printed curved surface body sample may be set to be perpendicular to the axial direction of the roll-like elastic blanket 2. In this case, it is necessary that the number of protrusion portions along the axis of the roll-like elastic blanket 2 is two at most, while the curvature radius of each protrusion portion is made large, and the difference in level thereof is made as low as possible.

When the protrusion portion has a comparatively large difference in level and when there are two protrusion portions, it is possible to deal with the two protrusion portions by modifying the outer circumferential shape of the roll-like elastic blanket 2. However, the distance between the two protrusion portions has to be long enough to prevent the longitudinal-axis-direction modified shapes of portions of the roll-like elastic blanket 2 corresponding to the protrusion portions from interfering with each other.

That is, the longitudinal-axis-direction modified outer circumferential shapes of the roll-like elastic blanket 2 must have a longer distance from each other at least based on an interference limit obtained as follows. The longitudinal-axis-direction principal curvature radius r1 and the eccentric distance X of the roll-like elastic blanket 2 are determined from the curvature radius R1 of the to-be-printed curved surface body as described previously. The interference limit is located in the intersection between the outer circumferential surface corresponding to the determined longitudinal-axis-direction principal curvature radius r1 and the height corresponding to the protrusion portion level difference H of the to-be-printed curved surface body 10.

EXAMPLE 2

Figure 6:
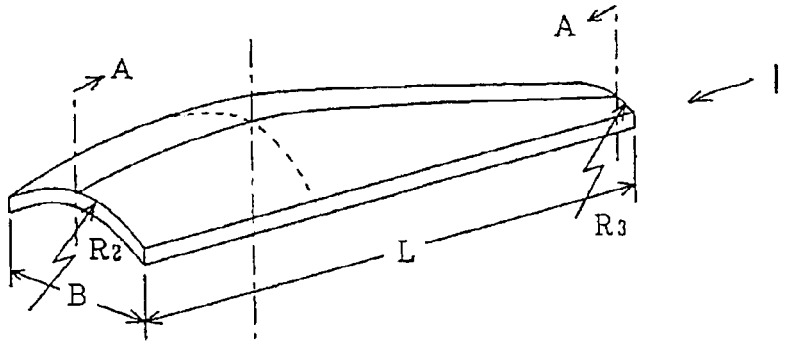
FIG. 6 are explanatory views showing the shape of a to-be-printed curved surface body sample 1 used in Example 2.
Figure 6:
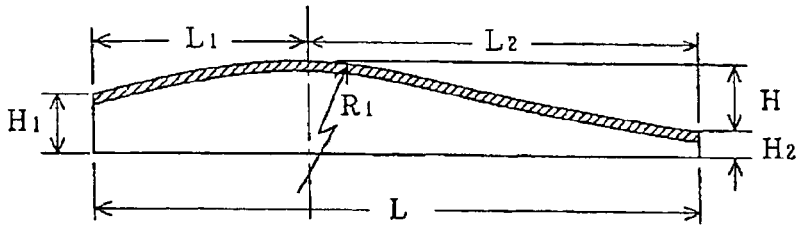
Figure 6:
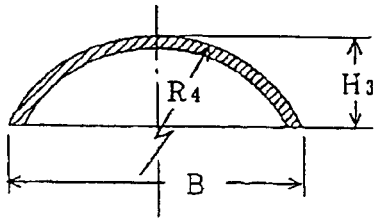
Figure 6:
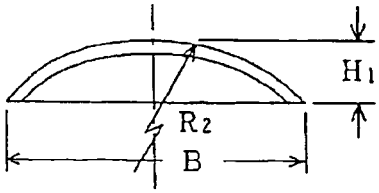
Figure 6:
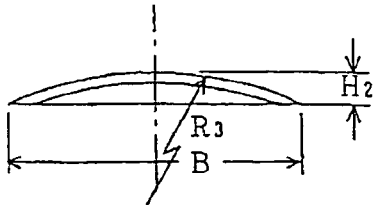

FIG. 6 are explanatory views showing the shape of a to-be-printed curved surface body sample 1 used in this Example 2, wherein (a) is a perspective reference view; (b) is a sectional reference view taken along line A-A'; (c) is a sectional reference view in a position of a highest protrusion portion; (d) is an end surface reference view of a portion $H_1$; and (e) is an end surface reference view of a portion $H_2$.

Figure 7:
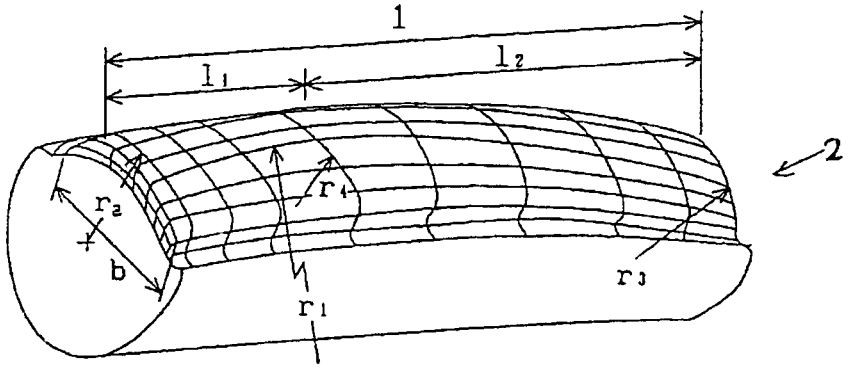
FIG. 7 are perspective reference views schematically showing a roll-like elastic blanket 2 in Example 2.
Figure 7:
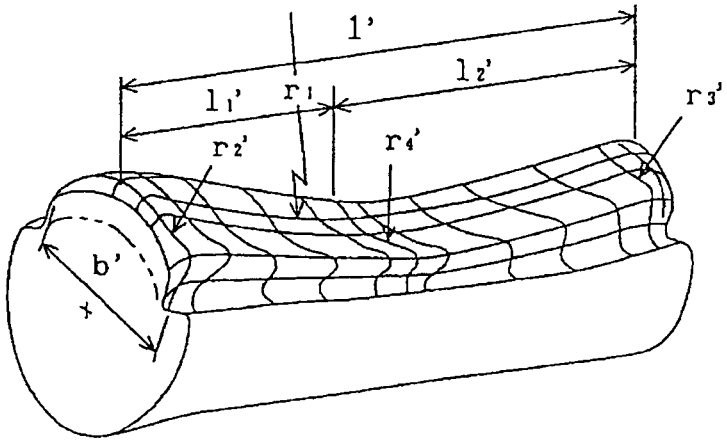

FIG. 7 are perspective reference views schematically showing the shape of a roll-like elastic blanket 2 in this Example 2, wherein (a) shows the case where the same polarity as the shape polarity of the to-be-printed curved surface body sample 1 was provided to the polarity of irregularities of the roll-like elastic blanket 2; and (b) shows the case where a polarity opposite to the shape polarity of the to-be-printed curved surface body sample was provided to the polarity of irregularities of the roll-like elastic blanket 2.

This Example 2 has specifications as follows.

to-be-printed curved surface body sample 1: (see FIG. 1)

$$L \times B \times H_3 \times R_1 = 110 \times 55 \times 15 \times 110$$

($L_1$; 40, $L_2$; 70, $R_2$; 45, $R_3$; 75, $R_4$; 35, H; 10, $H_1$; 10, $H_2$; 5 (by mm))

material; polypropylene material roll-like elastic blanket 2:

fundamentally cylindrical shape; roll D×d(axial diameter)×L=120 mm×40 mm×220 mm (a) r1; 132 (k=0.12), r2; 54 (k=0.14), r3; 90 (0.14), r4; 42 (k=0.14), l1; 80, 12; 140 (by mm)

(b) $r'_1$; 110 (k=0.05), $r'_2$; 45 (k=0.05), $r'_3$; 75 (k=0.05), $r'_4$; 35 (k=0.05), $l'_1$; 80, $l'_2$; 140 (by mm)

material; silicon rubber hardness (JIS A-scale); 15 surface roughness; 2 μm ink used:

UV-type ink (color; brass)

relief printing master plate 3:

relief master plate made of Al photosensitive agent protrusion portion height; 5 μm continuous woodgrain pattern printing machine:

horizontal displacement type three-stage blanket printing machine (Model 3 made by SHUHO)

Printing results by the roll-like elastic blankets 2 in (a) and (b) of this Example 2 were compared with a printing result by the elastic blanket having the fundamentally cylindrical shape. Those results were obtained in the same conditions except the shapes of the roll-like elastic blankets 2.

From the printing results based on eye observation, the woodgrain pattern in printing by the elastic blanket having the fundamentally cylindrical shape was irregular due to a large elongation near the highest protrusion portion. As compared therewith, in the roll-like elastic blankets 2 in (a) and (b) of this Example 2, slight elongation was observed in their corresponding portions, but it was within a range of product specifications and recognized as good. Longitudinal printing accuracy was good because of little elongation and little shrinkage as compared with that of the elastic blanket having the fundamentally cylindrical shape.

INDUSTRIAL APPLICABILITY

The present invention has been described on printing on a curved surface having a comparatively simple curvature radius in each Example, but it is applicable to printing not only on a simple curved surface but also on any complicated one if it is a curved surface.

DESCRIPTION OF REFERENCE NUMERALS AND SIGNS

1 . . . to-be-printed curved surface body sample, 2 . . . roll-like elastic blanket, 3 . . . relief printing master plate, 10 . . . to-be-printed curved surface body, 21 . . . two curved surfaces with principal curvature radius r1 in the elastic blanket, 22 . . . portion with rounded top portion where the two curved surfaces with the principal curvature radius r1 meet each other, 23 . . . elastic blanket base portion, R . . . curvature radius of section of the to-be-printed curved surface body perpendicular to longitudinal axis direction, R1 . . . curvature radius of longitudinal generatrix connecting outermost protrusion portions of sections of the to-be-printed curved surface body perpendicular to the longitudinal axis direction, r . . . curvature radius of the elastic blanket corresponding to the curvature radius R of the section of the to-be-printed curved surface perpendicular to the longitudinal axis direction, r1 . . . curvature radius of the elastic blanket corresponding to the curvature radius R1 of longitudinal generatrix of the to-be-printed curved surface body, R01,02,03 . . . curvature radius in each point on longitudinal generatrix connecting outermost protrusion portions of the to-be-printed curved surface body in the longitudinal axis direction, r01,02,03 . . . curvature radius of the elastic blanket corresponding to the curvature radius R01,02,03 . . . in each point on the longitudinal generatrix of the to-be-printed curved surface body, X . . . center moving distance (eccentric distance) of r1, B . . . sample breadth of the to-be-printed curved surface body sample, $B_1$ . . . sample breadth (1), $B_2$ . . . sample breadth (2), $B_3$ . . . sample breadth (3) to the highest protrusion portion, $B_4$ . . . sample breadth (4) to the highest protrusion portion, H . . . difference in level of the highest protrusion portion of the to-be-printed curved surface body sample, t . . . sample thickness, and θ . . . vertex angle in the portion with the rounded top portion where the two curved surface portions with r1 meet each other.

The invention claimed is:

1. A method for printing on a curved surface, comprising the steps of:

applying printing ink to a protrusion portion of a relief printing master plate which is a flat plate with the protrusion portion 0.1-15 μm high in height h;

pressing a rubber or rubbery roll-like elastic blanket onto the relief printing master plate disposed in a fixed position and supplied with the printing ink while applying constant pressure to the roll-like elastic blanket and smoothly rotating the roll-like elastic blanket, so as to transfer the printing ink to an outer circumferential surface of the roll-like elastic blanket; and moving the roll-like elastic blanket having the printing ink transferred thereto, and bringing the roll-like elastic blanket into rotational pressure contact with a surface of a to-be-printed curved surface body so as to perform printing thereon, wherein a radial thickness T of the roll-like elastic blanket has at least a relation of $2H \leq T \leq 8H$ to a level difference H among irregularities in the curved surface of the to-be-printed curved surface body, a material of the roll-like elastic blanket is silicone rubber, and hardness (JIS A-scale) thereof is 3-20, surface roughness of the roll-like elastic blanket is 0.5-2 μmin Hmax, and the printing ink is a UV ink having a viscosity of 5-250 PaS (at 25° C.).

2. The method for printing on a curved surface according to claim 1, wherein a height h of the protrusion portion of the relief printing master plate 3 is 0.1-25 μm.

3. The method for printing on a curved surface according to claim 1, wherein a height h of the protrusion portion of the relief printing master plate 3 is 0.1-15 μm.

4. The method of printing on a curved surface according to claim 1 wherein the printing ink has a viscosity of 5-250 PaS.

5. The method for printing on a curved surface according to claim 1, wherein an image of the protrusion portion of the relief printing master plate where the printing ink is applied is reduced or enlarged based on a ratio between an orthogonal projection of the curved surface of the to-be-printed curved surface body onto the relief printing master plate and a real length of the curved surface.

6. The method for printing on a curved surface according to claim 1, wherein the to-be-printed curved surface body is a to-be-printed curved surface body having a shape that is longer in a longitudinal axis direction than in a latitudinal axis direction, or a to-be-printed body where a plurality of to-be-printed curved surface bodies are arranged in parallel in the longitudinal axis direction.

7. A printed curved surface body having a surface printed by a method for printing on a curved surface according to claim 1.

8. The printed curved surface body according to claim 7, wherein the printed curved surface body is an automobile part.

9. The printed curved surface body according to claim 7, wherein the printed curved surface body is a handle or an interior or exterior member for a car.

10. The printed curved surface body according to claim 7, wherein the printed curved surface body is an exterior member of electronic equipment.

11. The printed curved surface body according to claim 7, wherein the printed curved surface body is an exterior member of a portable telephone.

12. The printed curved surface body according to claim 7, wherein the printed curved surface body is an ornament or a sporting tool.

13. The printed curved surface body according to claim 7, wherein the printed curved surface body is an eyeglass frame in an ornament.

14. A method for printing on a curved surface, comprising the steps of:

applying printing ink to a protrusion portion of a relief printing master plate which is a flat plate with the protrusion portion 0.1-15 μm high in height h;

pressing a rubber or rubbery roll-like elastic blanket, which has a curved surface with a predetermined shape set correspondingly to a curved surface of a to-be-printed curved surface body, onto the relief printing master plate disposed in a fixed position and supplied with the printing ink, so as to transfer the printing ink to the curved surface with the predetermined shape; and moving the roll-like elastic blanket having the curved surface with the predetermined shape having the printing ink transferred thereto, and bringing the roll-like elastic blanket into contact with the curved surface of the to-be-printed curved surface body so as to perform printing thereon, wherein a radial thickness T of the roll-like elastic blanket has at least a relation of $2H \leq T \leq 8H$ to a level difference H among irregularities of the curved surface of the to-be-printed curved surface body, a material of the roll-like elastic blanket is silicone rubber, and hardness (JIS A-scale) thereof is 3-20, surface roughness of the roll-like elastic blanket is 0.5-2 μm in Hmax, and the printing ink is a UV ink having a viscosity of 5-250 PaS (at 25° C.).

15. A printed curved surface body having a surface printed by a method for printing on a curved surface according to claim 14.

* * * * *